US012799834B2

(12) United States Patent
Etukudo

(10) Patent No.: US 12,799,834 B2
(45) Date of Patent: Nov. 17, 2026

(54) CASING RUNNING TOOL MULTI-GRIPPER

(71) Applicant: NABORS DRILLING TECHNOLOGIES USA, INC., Houston, TX (US)

(72) Inventor: Gustav Etukudo, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 19/074,875

(22) Filed: Mar. 10, 2025

(65) Prior Publication Data

US 2026/0266145 A1 Sep. 10, 2026

(51) Int. Cl.
*E21B 19/16* (2006.01)
*E21B 19/06* (2006.01)
*E21B 31/20* (2006.01)

(52) U.S. Cl.
CPC ..... *E21B 19/16* (2013.01); *E21B 19/06* (2013.01); *E21B 31/20* (2013.01)

(58) Field of Classification Search
CPC ..... E21B 19/06; E21B 19/07; E21B 19/16; E21B 31/20
See application file for complete search history.

(56) References Cited

U.S. PATENT DOCUMENTS 1,625,909 A * 4/1927 Price ..... E21B 31/20 294/96
2,689,763 A * 9/1954 Osmun ..... E21B 31/20 294/86.17
3,697,113 A * 10/1972 Palauro ..... E21B 31/20 294/86.12
7,552,764 B2 * 6/2009 Weems ..... B66C 1/42 166/85.1
7,744,140 B2 * 6/2010 Rowley ..... F16B 2/16 294/94
9,273,523 B2 * 3/2016 McIntosh ..... E21B 3/022
9,416,601 B2 * 8/2016 Mullins ..... E21B 19/07
9,797,207 B2 * 10/2017 McIntosh ..... E21B 31/20
9,896,891 B2 * 2/2018 Mullins ..... E21B 3/022
(Continued)

FOREIGN PATENT DOCUMENTS

CA 2512800 C * 10/2010 ..... B25B 13/5083
CA 3093164 A1 * 9/2019 ..... E21B 31/20
(Continued)

OTHER PUBLICATIONS

International Search Report and Written Opinion; International Application No. PCT/US2026/015293; International Filing Date Feb. 13, 2026; Date of Mailing May 13, 2026; 11 pages.

*Primary Examiner* — Jennifer H Gay
(74) *Attorney, Agent, or Firm* — Haynes and Boone, LLP

(57) ABSTRACT

The present disclosure provides a gripper for a casing running tool. The gripper includes an inner mandrel, which has a profile suitable for torque load transfer and a recessed portion having shoulders, and a split sleeve configured to be installed in the recessed portion of the inner mandrel. The split sleeve, which is configured to mate with the inner mandrel, includes an outer profile having a plurality of ramps. Each ramp of the outer profile of the split sleeve is configured to include a roller thereon such that each roller exhibits a radial force when the split sleeve is subjected to a downward force.

22 Claims, 19 Drawing Sheets

(56) References Cited

U.S. PATENT DOCUMENTS

| | | | | |
|---|---|---|---|---|
| 10,767,441 | B2 * | 9/2020 | Sharp, III | E21B 33/128 |
| 10,907,432 | B2 * | 2/2021 | Evertsen | E21B 31/20 |
| 10,975,633 | B2 * | 4/2021 | Hickl | E21B 19/10 |
| 2008/0164693 | A1 * | 7/2008 | Weems | B66C 1/42 285/317 |
| 2013/0292136 | A1 * | 11/2013 | McIntosh | E21B 3/022 166/381 |
| 2015/0107385 | A1 * | 4/2015 | Mullins | E21B 19/07 74/25 |
| 2015/0107851 | A1 * | 4/2015 | Mullins | E21B 19/00 166/78.1 |
| 2015/0300112 | A1 * | 10/2015 | Hered | E21B 19/07 166/382 |
| 2016/0177639 | A1 * | 6/2016 | McIntosh | E21B 31/20 166/381 |
| 2019/0048677 | A1 * | 2/2019 | Evertsen | E21B 31/20 |
| 2019/0352978 | A1 * | 11/2019 | Gherardi | E21B 19/07 |
| 2020/0072015 | A1 * | 3/2020 | Sharp, III | E21B 23/06 |
| 2020/0347683 | A1 * | 11/2020 | Hickl | E21B 3/022 |

FOREIGN PATENT DOCUMENTS

| | | | | | |
|---|---|---|---|---|---|
| GB | 2280459 | A * | 2/1995 | | E21B 31/16 |
| NO | 335 633 | B1 | 1/2015 | | |
| WO | WO-2007127737 | A2 * | 11/2007 | | E21B 3/022 |
| WO | WO-2009025832 | A1 * | 2/2009 | | E21B 3/022 |
| WO | WO-2011056163 | A1 * | 5/2011 | | E21B 3/022 |
| WO | WO 2012/100019 | A1 | 7/2012 | | |
| WO | WO-2017151325 | A1 * | 9/2017 | | E21B 31/20 |
| WO | WO 2023/172417 | A1 | 9/2023 | | |

* cited by examiner

CASING RUNNING TOOL MULTI-GRIPPER

FIELD OF THE DISCLOSURE

The present disclosure relates to processes and systems for a casing running tool and specifically a gripper capable of running differing size casings and capable of transferring weight and/or torque loads of a casing string to different portions of the tool with various advantages.

BACKGROUND

Casing running tools generally comprise two main components; an actuator and a gripper. The actuator is usually attached below a top-drive via a sub or crossover while the gripper is often attached to the bottom of the actuator. The casing running tool (an actuator and a gripper working together) are employed to support the weight of a casing string and to transfer torque from the top drive to the casing string for purposes of, for example, including casing make up, reaming, and/or drilling with casing.

The gripper often features ramps oriented so that rollers that may be located on the ramps are pushed outward as the rollers are pushed downward. The rollers are pushed downwards by a cage which generally has a separate attachment to the actuator which actuator is hydraulically energized. The gripper attaches to the inside of the casing below the casing coupling by means of the rollers when they are pushed down and out by the actuator.

Unfortunately, high contact stresses on the gripper ramps often result in indented locations along the gripper ramps. The indented areas tend to impede the movement of the rollers along the ramp and/or reduce the amount of radial contact force that the rollers are capable of applying to the inside of the casing. The reduced contact force between the rollers and the casing results in a less effective grip between the rollers and the casing string. This can cause the casing running tool to slip on the casing resulting in improper casing make-ups, dropped casing strings, and/or other hazards.

What's more, the gripper is exposed to drilling fluids, heat, cold, moisture, and/or other elements that contribute to corrosion of the ramps surfaces. Corrosion and/or the build-up of corrosion by products deleteriously increases the friction between moving elements of the gripper in contact with each other. This can also cause the casing running tool to slip on the casing resulting in improper casing make-ups, dropped casing strings, and/or other hazards.

What is needed are improved systems and processes to reduce stress on the gripper ramps, reduce indented locations on gripper ramps, and/or improve performance of the gripper ramps. It would also be desirable if improved systems and processes could increase resistance to corrosion and/or otherwise improve performance of grippers in casing running tool products. It would also be advantageous if improved systems and processes could allow for running of different size casings. Advantageously, the systems and processes described here accomplish one or more up to all of the aforementioned needs.

SUMMARY

In one embodiment, the application pertains to a gripper for a casing running tool. The gripper comprises an inner mandrel comprising a profile suitable for torque load transfer at the top and the bottom of the inner mandrel. The inner mandrel comprises a recessed portion located between the top profile and bottom profile wherein the recessed portion comprises a plurality of shoulders. The gripper comprises a split sleeve configured to be installed in the recessed portion of the inner mandrel. The split sleeve comprises an inner profile configured to mate with (1) the top profile and bottom profile of the inner mandrel and (2) the plurality of shoulders of the recessed portion of the inner mandrel. In some embodiments the split sleeve is a single sleeve. In other embodiments, the split sleeve is split longitudinally into at least two pieces wherein the at least two pieces of the split sleeve are configured to be longitudinally fastened together. The inner mandrel and split sleeve are in rotational communication when the at least two pieces of the split sleeve are longitudinally fastened together and the split sleeve is installed in the recessed portion of the inner mandrel.

In other embodiments the application pertains to casing running tools and methods of using.

BRIEF DESCRIPTION OF THE DRAWINGS

Various embodiments of the present disclosure, together with further objects and advantages, may best be understood by reference to the following description taken in conjunction with the accompanying drawing with a full description of each figure in the examples section below.

DETAILED DESCRIPTION

Inner Mandrel of Gripper

Figure 1:
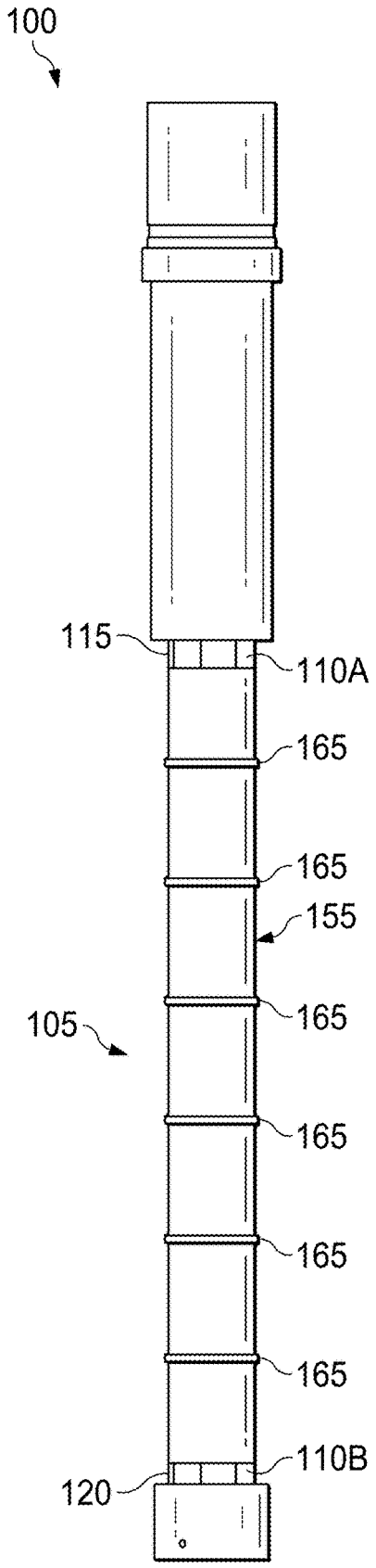
FIG. 1 shows an inner mandrel.

This application pertains to casing running tools with a unique gripper 100. Generally, the gripper 100 comprises an inner mandrel 105 comprising a profile 110A,110B suitable for torque load transfer at the top 115 and the bottom 120 of the inner mandrel 105, respectively. Such profiles 110A, 110B may be the same or different at the top 115 and the bottom 120. In preferred embodiments the top and bottom profile 110A,110B are substantially the same so long as they are each suitable for torque load transfer. The specific profile 110A,110B employed may vary depending upon, for example, the desired torque load, the materials used, and the size of the inner mandrel 105 and sleeve 160.

In some embodiments the top and/or bottom profile 110A, 110B comprise one or more keys 125 such as a polygonal, e.g., square, piece that is configured to fit into one or more keyways 130 on a shaft 135 of a mating component 140 such as an actuator or an intermediate sub to facilitate torque transfer. In some embodiments the top and/or bottom profile 110A,110B comprise one or more splines 145, e.g., ridges or teeth, which are configured to interlock with corresponding grooves on a mating component 140 such as an actuator or an intermediate sub to facilitate torque transfer without a separate key. In some embodiments the top and/or bottom profile 110A,110B comprise a polygonal profile. The particular polygon employed is not particularly critical so long as it is capable of transferring the desired amount of torque load at both the bottom 120 and top 115 of the inner mandrel 105. In some embodiments the polygon of the polygonal profile is selected from a polygon comprising from about 4, or from about 6, up to about 10 sides, or up to about 12 sides. Suitable shapes may include, for example, triangle, quadrilateral, pentagon, hexagon, heptagon, nonagon, decagon, etc. The selected profile 110A,110B for torque load transfer at the top 115 and the bottom 120 of the inner mandrel 105 may be the same or different on the top 115 and bottom 120 and are preferable the same. In preferred embodiments the profile 110A,110B suitable for torque load transfer at the top 115 and the bottom 120 of the inner mandrel 105 comprises an octagonal profile.

A recessed portion 155 is located between the top profile 110A and bottom profile 110B wherein the recessed portion 155 is configured for a split sleeve 160 to be installed therein. In some embodiments, the recessed portion 155 of the inner mandrel 105 comprises a plurality of shoulders 165 in order to facilitate a tight fit or attachment between the inner mandrel 105 and a split sleeve 160 so that they rotate together and/or facilitate transfer of a tensile load from, for example, tubulars that the gripper 100 will be used to grip.

The number of shoulders 165 is not particularly critical so long as the shoulders 165 facilitate transfer of tensile load and in some embodiments may be at least about 3, or at least about 5, or at least about 10, or at least about 20, up to about 30, or up to about 40, or up to about 45 shoulders 165 depending upon the length of the inner mandrel 105. In one specific embodiment, 24 shoulders 165 are employed. That is, longer inner mandrels 105 may employ more shoulders 165 than shorter inner mandrels 105.

Split Sleeve of the Gripper

The gripper 100 generally has a split sleeve 160 that is configured to be installed in the recessed portion 155 of the inner mandrel 105. The split sleeve 160 may be split in any convenient manner so long as it may be removed from the inner mandrel 105 and replaced in order to match the dimensions of the tubular to be worked on by the gripper 100 and/or to replace a worn or corroded portion of the split sleeve 160. The split sleeve 160 may be installed in the recessed portion 155 of the inner mandrel 105 in any manner so long as the inner mandrel 105 and split sleeve 160 are in rotational communication, e.g., the split sleeve 160 and inner mandrel 105 rotate together as opposed to independently.

In some embodiments, the split sleeve 160 is split longitudinally into at least two pieces 160A, 160B wherein the at least two pieces 160A, 160B of the split sleeve 160 are configured to be longitudinally fastened together and installed in the recessed portion 155 of the inner mandrel 105. The split sleeve 160 usually comprises an inner profile 170 configured to mate with (1) the top profile 110A and bottom profile 110B of the inner mandrel 105 and (2) the plurality of shoulders 165 of the recessed portion 155 of the inner mandrel 105. In this manner rotational communication is facilitated.

The at least two pieces 160A,160B of the split sleeve 160 are configured to be longitudinally fastened together in any convenient manner with any type of suitable fastener 172 which is preferably a removable fastener, e.g., screws, pins, staples, clips, magnetic fasteners, etc. In some embodiments, the at least pieces 160A, 160B are fastened together with one or more screws on one and/or opposing and/or adjacent sides at the top while one or more screws may also be on the bottom on one and/or opposing and/or adjacent sides. For example, in one embodiment one or more screws may be adjacent the top profile 110A of the inner mandrel 105 and a second set of one or more screws may be adjacent the bottom profile 110B of the inner mandrel 105.

The split sleeve 160 may be any convenient shape and is generally the same shape as the tubulars which it is designed to grip. Thus, in preferred embodiments the split sleeve 160 is substantially cylindrical with dimensions to match tubulars which it is designed to grip. In substantially cylindrical split sleeve 160 embodiments the at least two pieces 160A, 160B of the split sleeve 160 may comprise a cylinder longitudinally split so as to form two semicircular cylinder pieces 160A,160B. The outer perimeter 178A,178B of the two semicircular pieces 160A,160B may be the same or different and in some embodiments the two semicircular cylinder pieces 160A,160B comprise substantially the same outer perimeter 178A,178B. In this manner the two semicircular pieces 160A,160B may be longitudinally fastened together with a screw adjacent the top profile 110A of the inner mandrel 105 and a second screw adjacent the bottom profile 110B of the inner mandrel 105.

The outer profile 180 of the split sleeve 160 may vary depending upon the tubulars which will be worked on by the gripper 100. Generally, the split sleeve 160 comprises an outer profile 180 comprising a plurality of ramps 185. Each ramp 185 is configured to comprise one or more rollers 190 thereon. In some embodiments a cage 195 applies a downward force F on the one or more rollers 190 which moves the rollers 190 radially outward and into a top end of the casing 200. In some embodiments the rollers 190 may be moved radially outward and into the lower end of the casing 200 by pulling the gripper 100 up against the downward weight of the casing 200. In this manner the inner mandrel 105 and sleeve 160 are pulled up which pushes the rollers 190 radially outward and into the interior of the casing 200.

Casing Running Tools with Grippers

A casing running tool may be designed using the grippers 100 described above. Such casing running tools comprise the gripper 100 described above attached to an actuator (hydraulic or other actuator). The actuator is configured to be attached to a top drive with, for example, a sub or crossover sub. In this manner torque may be transferred from the top drive to the attached gripper 100. Tubulars, e.g., casing 200, may be made up or moved using the gripper 100.

When using the gripper 100 described herein the outer diameter D of the split sleeve 160 may be designed such that the diameter D is sufficient for the making up of the tubulars to be connected. That is, the diameter D is selected to so that the rollers 190 on the split sleeve's 160 outer profile 180 exhibit a radial force when the split sleeve 160 is subjected to a downward force F. The gripper 100 can then be stabbed into the interior of a tubular to grip the casing 200 and it may be moved and/or made up.

FIG. 1 shows an exemplary inner mandrel 105 having an octagonal top profile 110A and bottom profile 110B with shoulders 165 for tensile load transfer. The shoulders 165 are in a recessed area of the inner mandrel 105 between the octagonal top profile 110A and octagonal bottom profile 110B.

Figure 2:
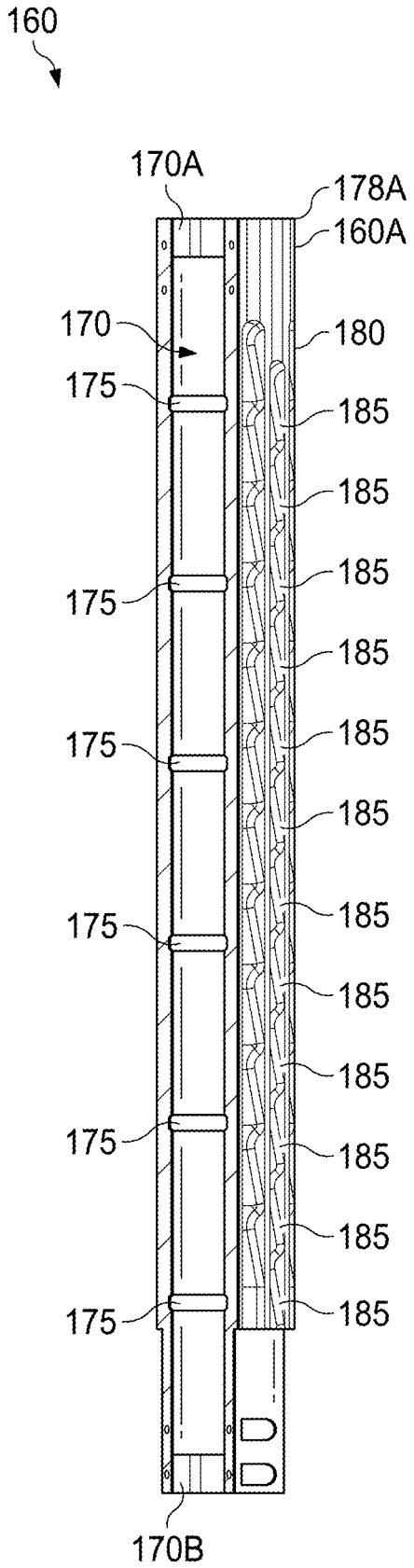
FIG. 2 shows half of a split sleeve.

FIG. 2 shows an exemplary split sleeve 160 wherein the sleeve 160 is longitudinally split in about two equal halves 160A,160B. The inner profile 170 of the split sleeve 160 has an octagonal profile 170A,170B and shoulders 175 to match the inner mandrel 105 so that the split sleeve 160 may be attached to the inner mandrel 105 in the recessed area of the inner mandrel 105.

Figure 3:
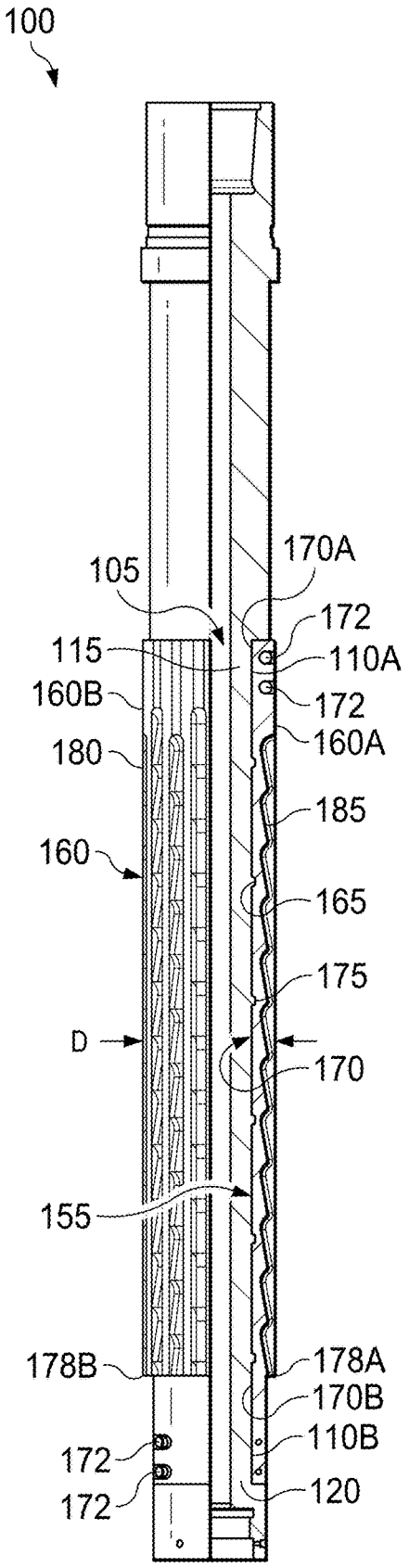
FIG. 3 shows an inner mandrel with a split sleeve installed.
Figure 4:
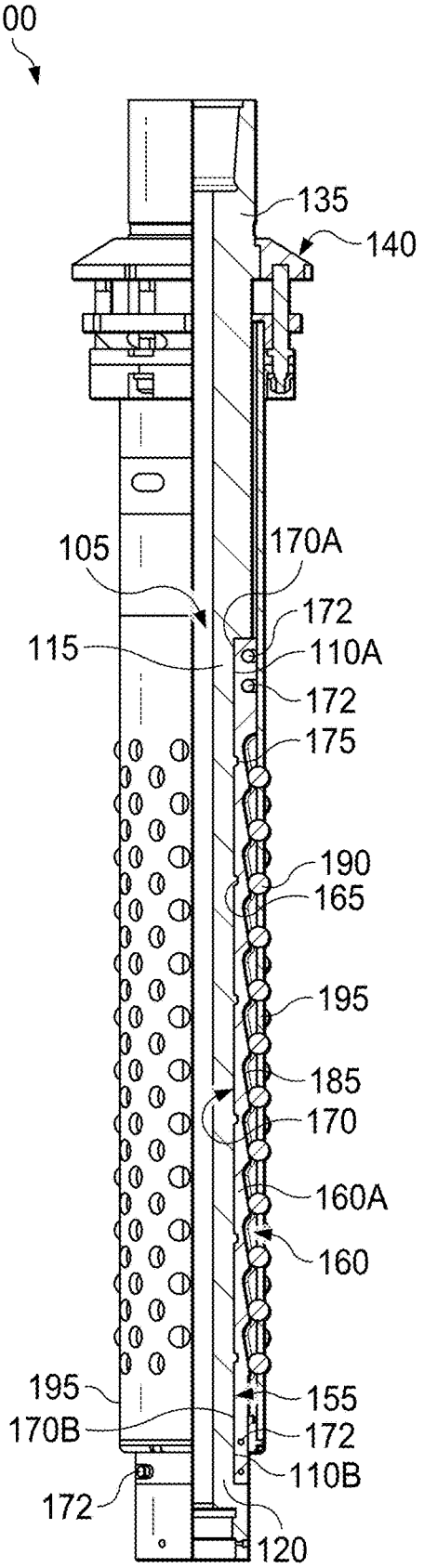
FIG. 4 shows a gripper assembly.

FIG. 3 shows the inner mandrel 105 of FIG. 1 with the split sleeve 160 installed while FIG. 4 shows the complete gripper 100 assembly.

FIG. 4 shows a gripper 100 assembly.

Figure 5:
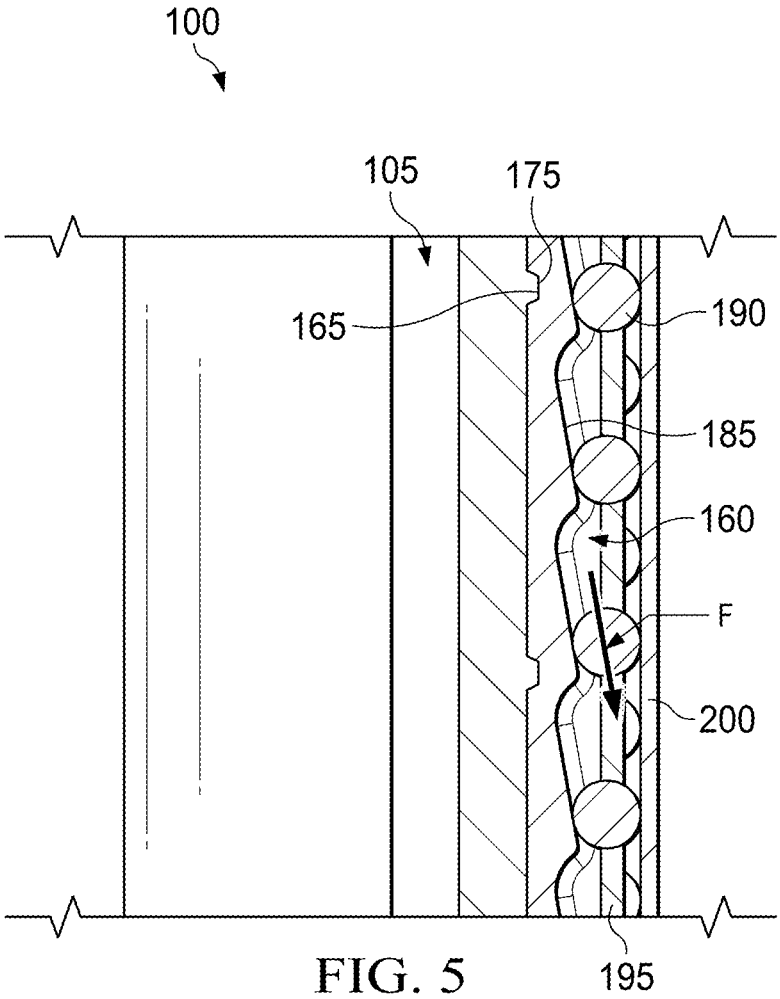
FIG. 5 shows casing supported by gripper.

FIG. 5 shows a cross-section of a casing 200 joint being supported by a gripper 100 wherein the ramps 185 and rollers 190 are shown on the outer profile 180 of the split sleeve 160. As shown in FIG. 5, the ramps 185 may suffer indentation damage due to the forces applied over time. Advantageously, if that happens to the grippers 100 described here the damaged portion of the outer sleeve 160 can simply be replaced.

Figure 6:
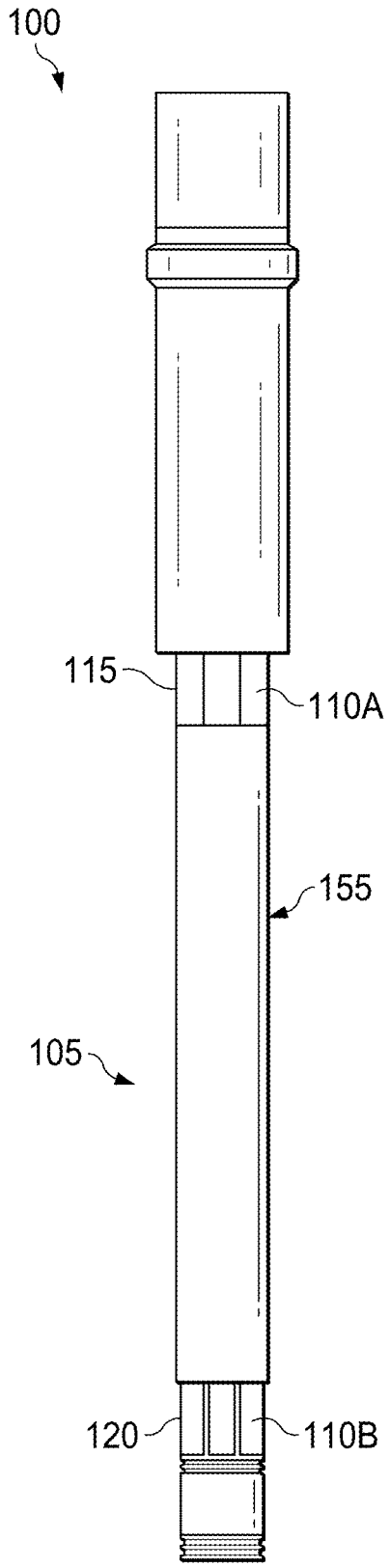
FIG. 6 shows an inner mandrel suitable for a single sleeve.
Figure 7:
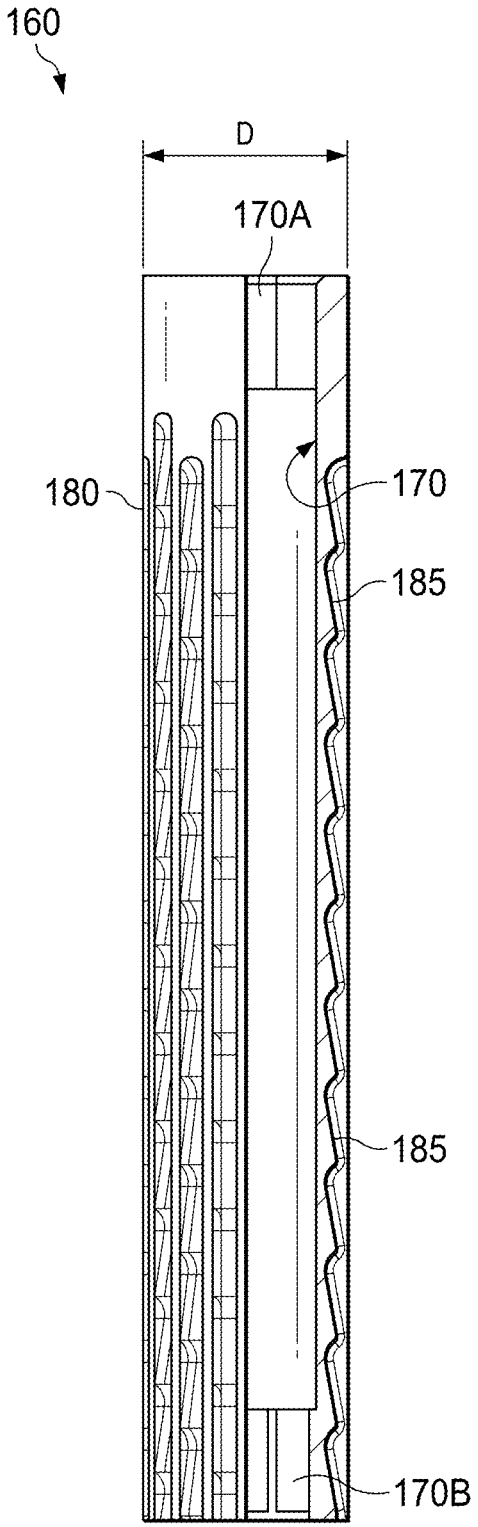
FIG. 7 shows a single sleeve for installing on an inner mandrel.
Figure 8:
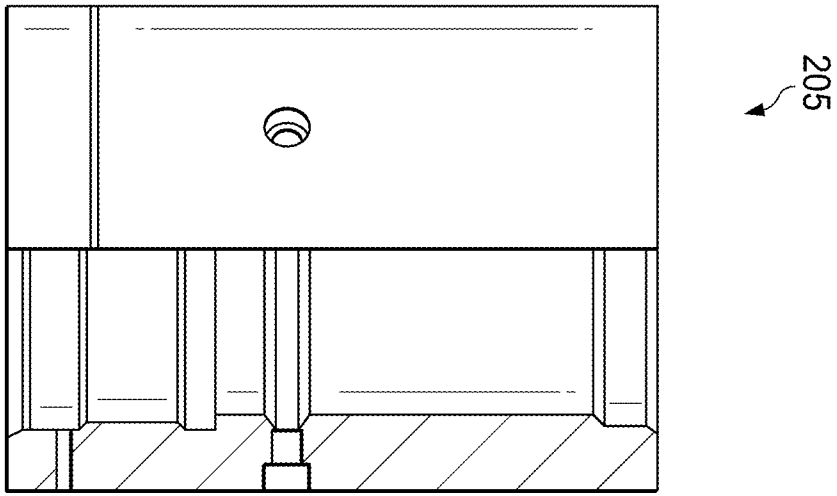
FIG. 8 shows a bottom locking nut for a single sleeve embodiment.
Figure 9:
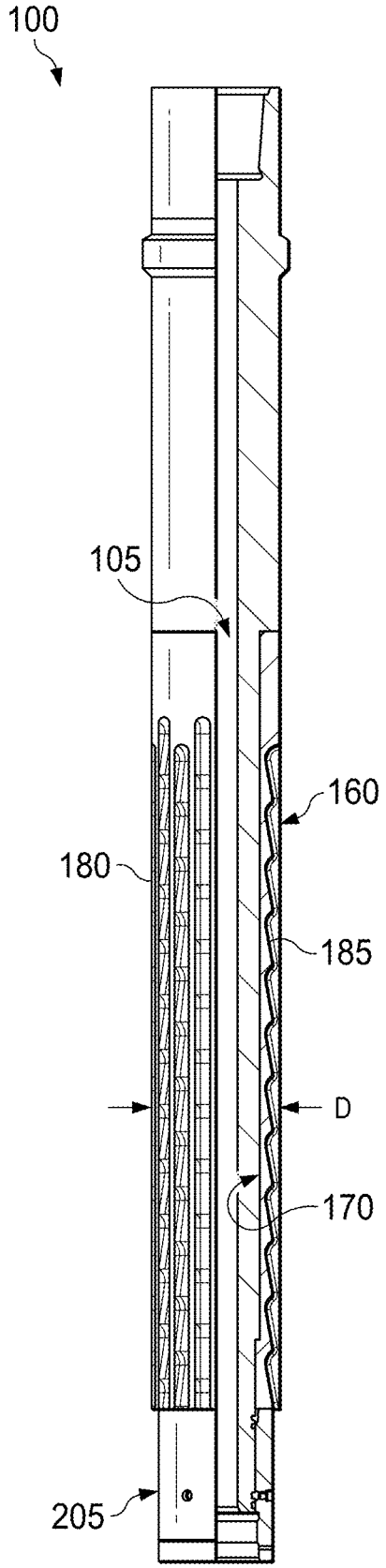
FIG. 9 shows a single sleeve on an inner mandrel with a bottom locking nut.
Figure 10:
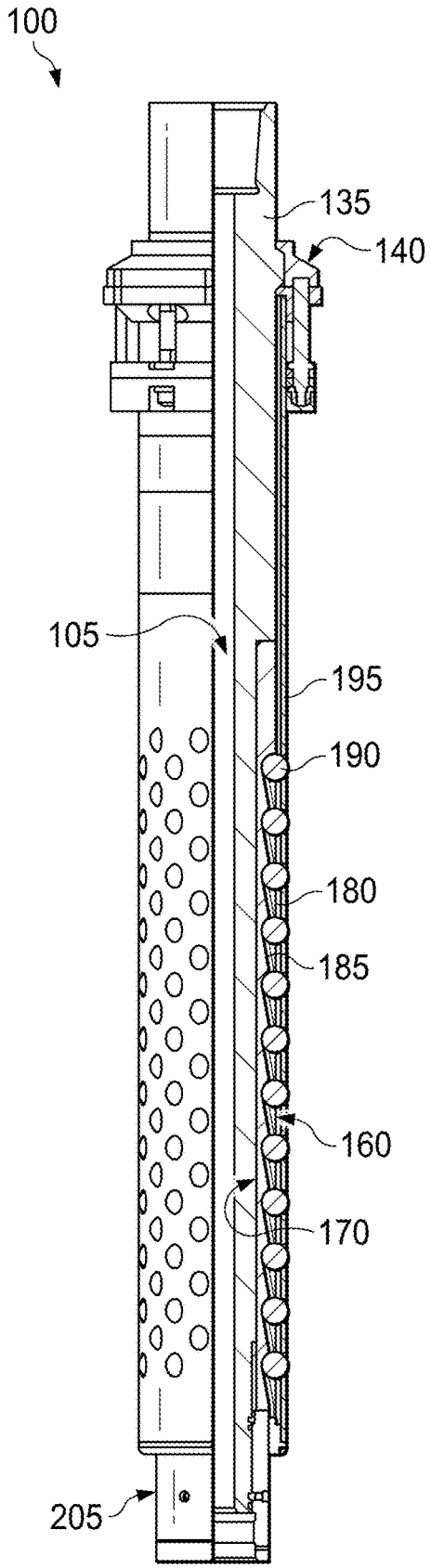
FIG. 10 shows a single sleeve gripper mandrel assembly with a single sleeve.
Figure 11:
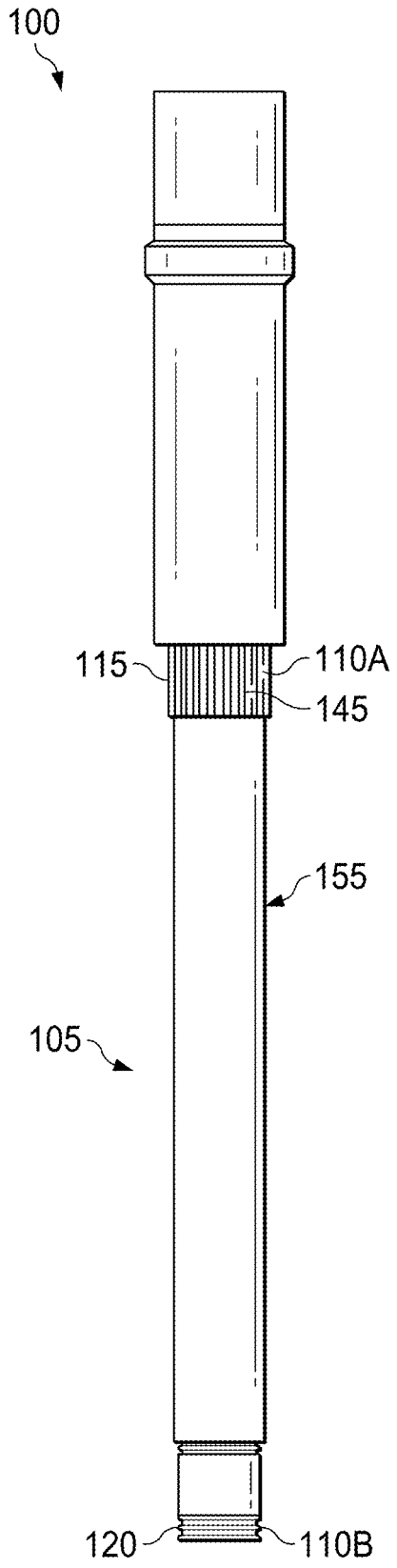
FIG. 11 shows an inner mandrel with spline suitable for a single sleeve.
Figure 12:
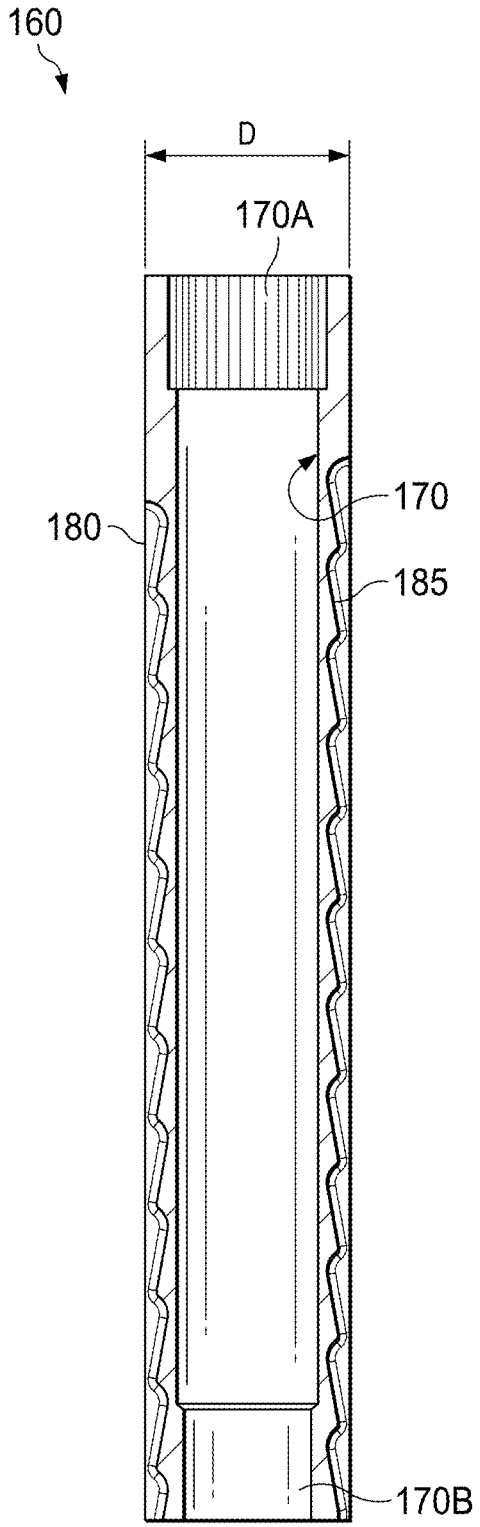
FIG. 12 shows a single sleeve for installing on an inner mandrel with a spline profile.
Figure 13:
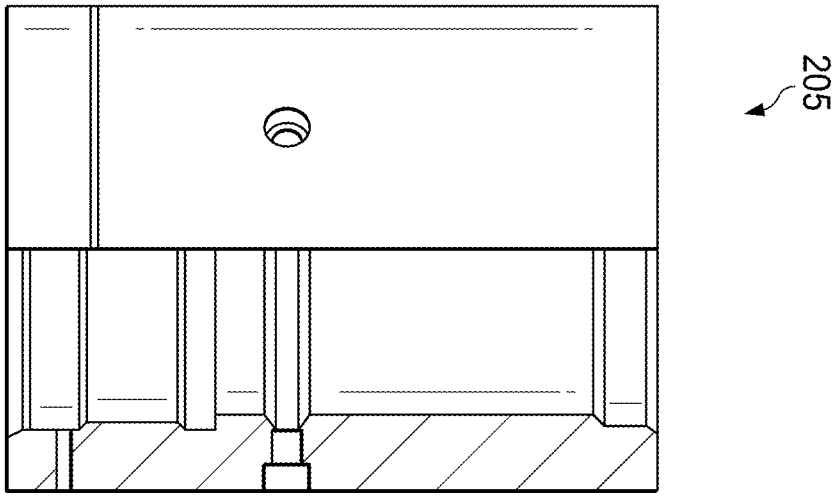
FIG. 13 show a bottom locking nut for a single sleeve embodiment with spline.
Figure 14:
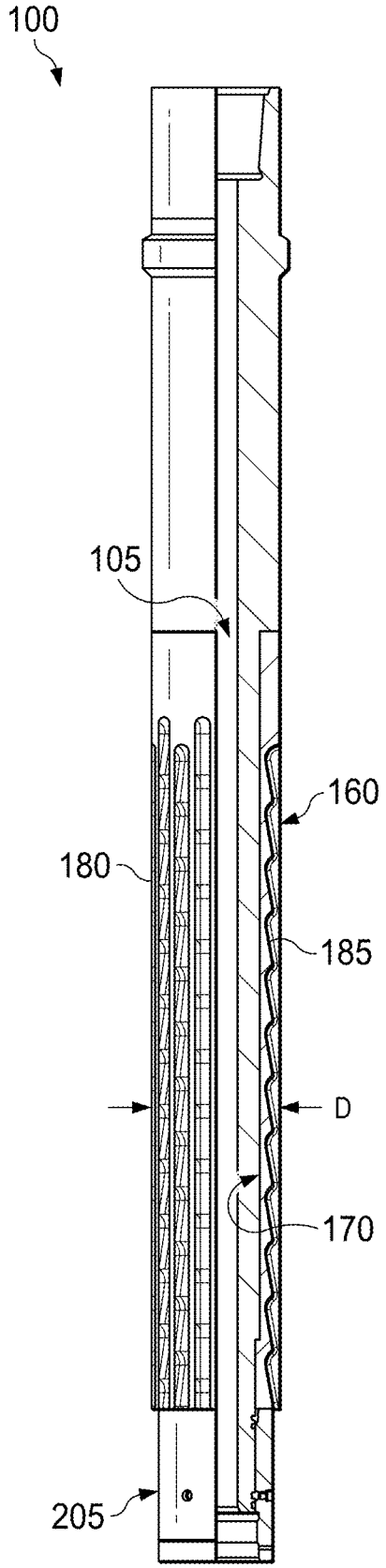
FIG. 14 shows a single sleeve with spline on an inner mandrel with spline with a bottom locking nut.
Figure 15:
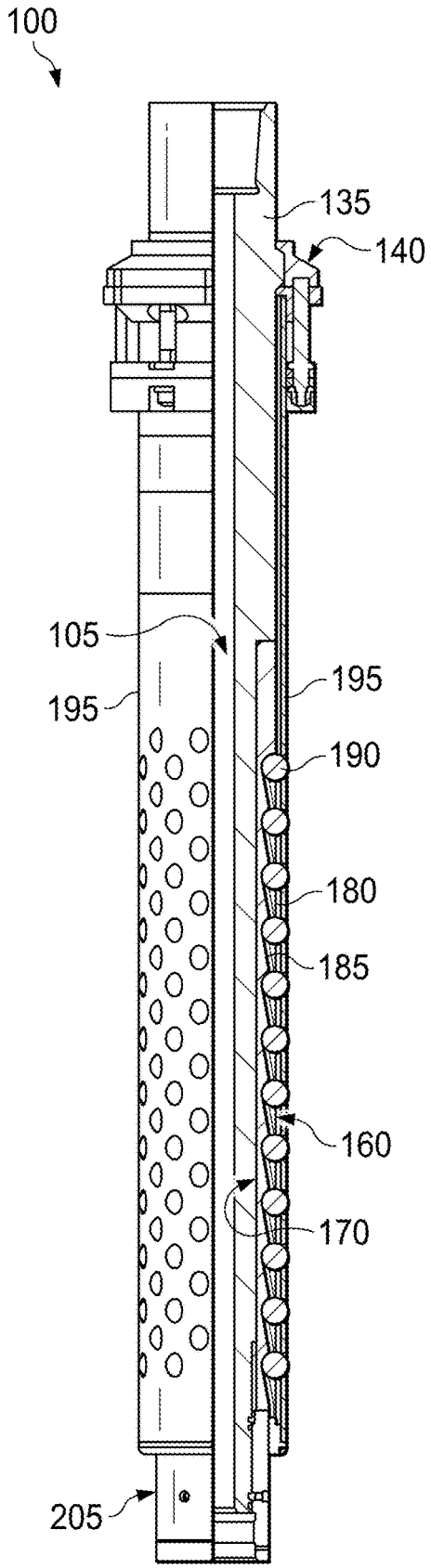
FIG. 15 shows a gripper mandrel assembly with a single sleeve with spline.
Figure 16:
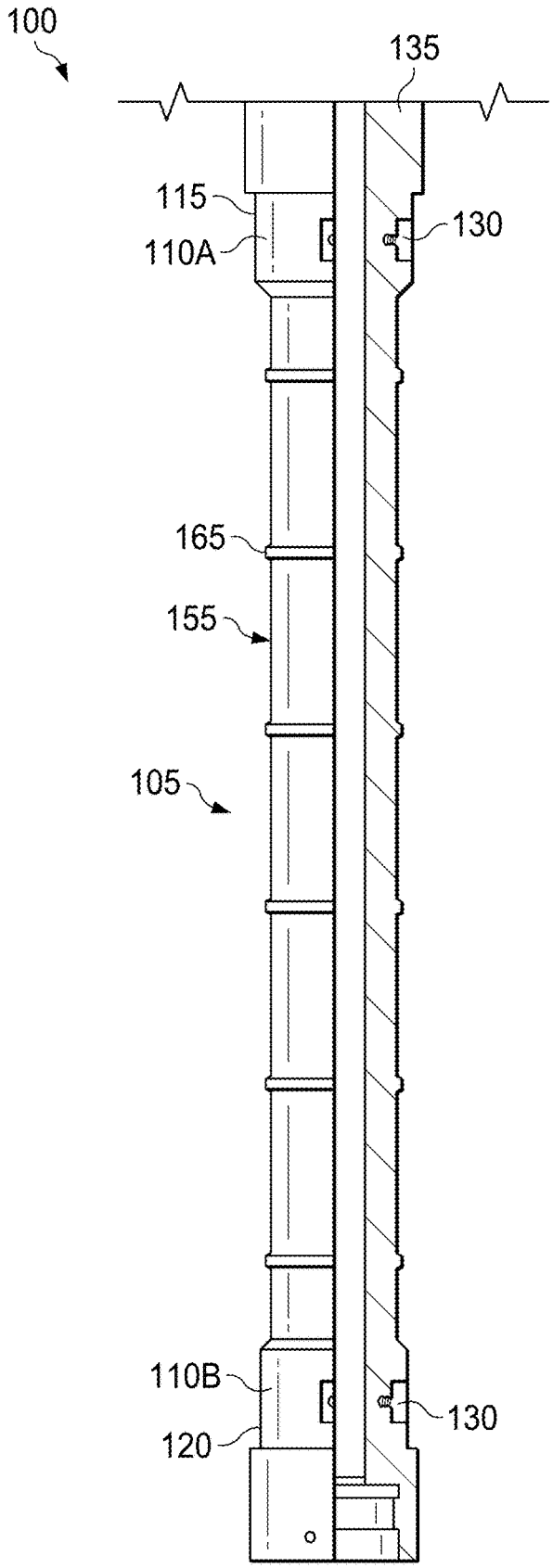
FIG. 16 shows a keyed inner mandrel.
Figure 17:
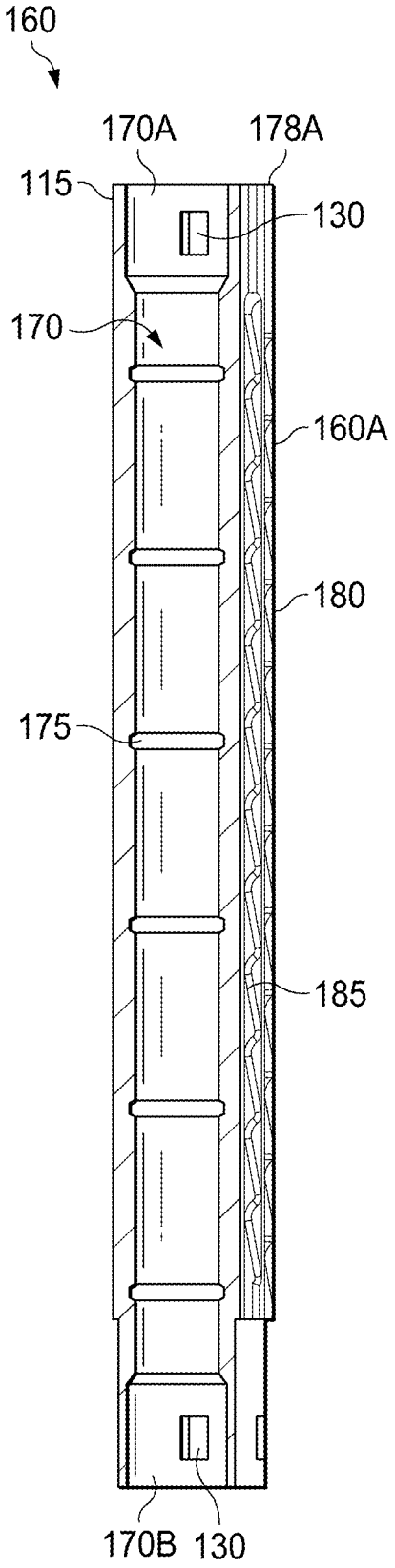
FIG. 17 shows a split sleeve with a key slot for a keyed inner mandrel.
Figure 18:
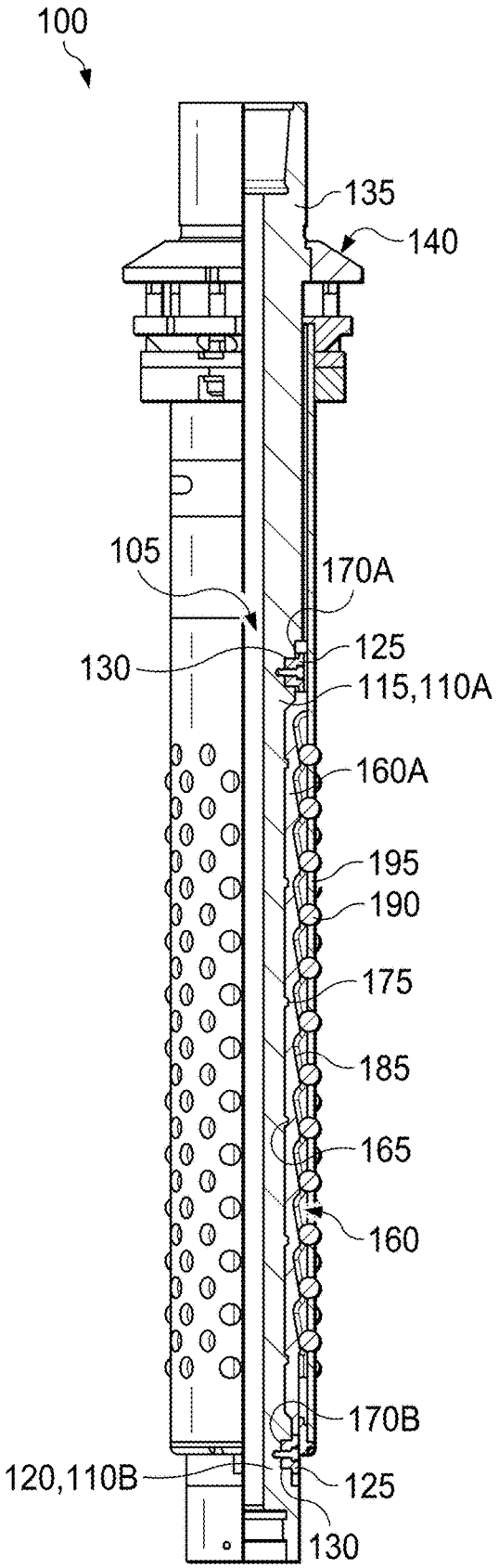
FIG. 18 shows a keyed gripper mandrel assembly.
Figure 19:
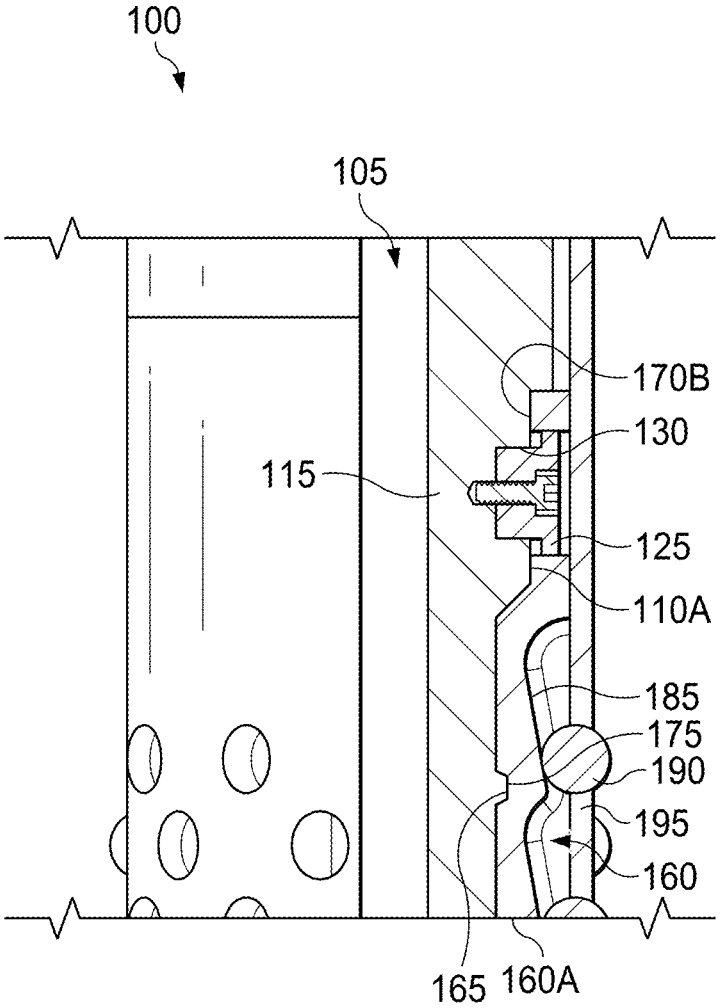
FIG. 19 shows a close-up view of the key on a keyed gripper mandrel assembly.

FIGS. 6-10 show single sleeve 160 embodiments. Specifically, FIG. 6 shows an inner mandrel 105 suitable for installing the single sleeve 160 shown in FIG. 7. While an octagonal profile is shown for toque load transfer it should be understood that any suitable profile (polygonal or otherwise) may be employed. A bottom locking nut 205 is employed as shown in FIG. 8 for fastening the sleeve 160 in place but any suitable fastening mechanism may be employed. FIG. 9 shows the inner mandrel 105 with single sleeve 160 installed with the bottom locking nut 205 while FIG. 10 shows the gripper mandrel assembly.

FIGS. 11-15 show single sleeve 160 embodiments wherein a spline 145 profile is employed instead of the polygonal profile employed in FIG. 6-10.

FIGS. 16-19 show a keyed split sleeve 160 embodiments wherein a top and bottom key slot 130 are employed although the slots 130 may differ in number and/or location so long as the mechanism provides sufficient torque load and sleeve 160 retention.

Specific Embodiments

Specific embodiments are described in the numbered embodiments below.

1. A gripper for a casing running tool comprising:

an inner mandrel comprising a profile suitable for torque load transfer at the top and the bottom of the inner mandrel;

wherein the inner mandrel comprises a recessed portion located between the top profile and bottom profile;

wherein the recessed portion comprises a plurality of shoulders; and a split sleeve configured to be installed in the recessed portion of the inner mandrel;

wherein the split sleeve comprises an inner profile configured to mate with (1) the top profile and bottom profile of the inner mandrel and (2) the plurality of shoulders of the recessed portion of the inner mandrel;

wherein the split sleeve is split longitudinally into at least two pieces wherein the at least two pieces of the split sleeve are configured to be longitudinally fastened together; and wherein the inner mandrel and split sleeve are in rotational communication when the at least two pieces of the split sleeve are longitudinally fastened together and the split sleeve is installed in the recessed portion of the inner mandrel.

2. The gripper of embodiment 1 wherein the profile suitable for torque load transfer comprises a polygonal profile selected from a polygon comprising from about 4 to about 12 sides.

3. The gripper of embodiment 1 wherein the profile suitable for torque load transfer at the top and the bottom of the inner mandrel are the same.

4. The gripper of embodiment 1 wherein the profile suitable for torque load transfer at the top and the bottom of the inner mandrel comprises an octagonal profile.

5. The gripper of embodiment 1 wherein the plurality of shoulders comprises from about 3 to about 40 shoulders.

6. The gripper of embodiment 5 wherein the plurality of shoulders comprises from about 20 to about 30 shoulders.

7. The gripper of embodiment 1 wherein the split sleeve is substantially cylindrical.

8. The gripper of embodiment 1 wherein the at least two pieces of the split sleeve are configured to be longitudinally fastened together with a screw adjacent the top profile of the inner mandrel and a second screw adjacent the bottom profile of the inner mandrel.

9. The gripper of embodiment 7 wherein the at least two pieces of the split sleeve comprise two semicircular pieces wherein the two semicircular pieces comprise substantially the same outer perimeter.

10. The gripper of embodiment 9 wherein the two semicircular pieces are configured to be longitudinally fastened together with a screw adjacent the top profile of the inner mandrel and a second screw adjacent the bottom profile of the inner mandrel.

11. The gripper of embodiment 1 wherein the plurality of shoulders are configured to transfer tensile load of a tubular.

12. The gripper of embodiment 1 wherein the split sleeve comprises an outer profile comprising a plurality of ramps, wherein each ramp is configured to comprise one or more rollers thereon and wherein the outer profile is configured such that the one or more rollers exhibit a radial force when the split sleeve is subjected to a downward force.

13. A gripper for a casing running tool comprising:

an inner mandrel comprising an octagonal profile suitable for torque load transfer at the top and the bottom of the inner mandrel;

wherein the inner mandrel comprises a recessed portion located between the top profile and bottom profile;

wherein the recessed portion comprises from about 20 to about 30 shoulders; and a split sleeve configured to be installed in the recessed portion of the inner mandrel;

wherein the split sleeve comprises an inner profile configured to mate with (1) the top profile and bottom profile of the inner mandrel and (2) the from about 5 to about 10 shoulders of the recessed portion of the inner mandrel;

wherein the split sleeve is split longitudinally into two semicircular pieces having substantially the same outer perimeter configured to be longitudinally fastened together with a screw near the top profile and a screw near the bottom profile;

wherein the split sleeve comprises an outer profile comprising a plurality of ramps, wherein each ramp is configured to comprise one or more rollers thereon and wherein the outer profile is configured such that the one or more rollers exhibit a radial force when the split sleeve is subjected to a downward force; and wherein the inner mandrel and split sleeve are in rotational communication when the two semicircular pieces of the split sleeve are longitudinally fastened together and the split sleeve is installed in the recessed portion of the inner mandrel.

14. A casing running tool comprising:

an actuator configured to be attached to a top drive and transfer torque from the top drive to a gripper; and a gripper for the casing running tool wherein the gripper comprises:

an inner mandrel comprising a profile suitable for torque load transfer at the top and the bottom of the inner mandrel;

wherein the inner mandrel comprises a recessed portion located between the top profile and bottom profile;

wherein the recessed portion comprises a plurality of shoulders; and a split sleeve configured to be installed in the recessed portion of the inner mandrel;

wherein the split sleeve comprises an inner profile configured to mate with (1) the top profile and bottom profile of the inner mandrel and (2) the plurality of shoulders of the recessed portion of the inner mandrel;

wherein the split sleeve is split longitudinally into at least two pieces wherein the at least two pieces of the split sleeve are configured to be longitudinally fastened together; and wherein the inner mandrel and split sleeve are in rotational communication when the at least two pieces of the split sleeve are longitudinally fastened together and the split sleeve is installed in the recessed portion of the inner mandrel.

15. The casing running tool of embodiment 14 wherein the profile suitable for torque load transfer at the top and the bottom of the inner mandrel comprises an octagonal profile.

16. The casing running tool of embodiment 14 wherein the plurality of shoulders comprises from about 20 to about 30 shoulders.

17. The casing running tool of embodiment 14 wherein the at least two pieces of the split sleeve are configured to be longitudinally fastened together with a screw adjacent the top profile of the inner mandrel and a second screw adjacent the bottom profile of the inner mandrel and wherein the at least two pieces of the split sleeve comprise two semicircular pieces wherein the two semicircular pieces comprise substantially the same outer perimeter and are configured to be longitudinally fastened together with a screw adjacent the top profile of the inner mandrel and a second screw adjacent the bottom profile of the inner mandrel.

18. The casing running tool of embodiment 14 wherein the plurality of shoulders are configured to transfer tensile load of a tubular.

19. The casing running tool of embodiment 14 wherein the split sleeve comprises an outer profile comprising a plurality of ramps, wherein each ramp is configured to comprise one or more rollers thereon and wherein the outer profile is configured such that the one or more rollers exhibit a radial force when the split sleeve is subjected to a downward force.

20. A process of using a casing running tool comprising:

(1) providing a casing running tool to make up tubular connections, wherein the casing running tool comprises:

an actuator configured to be attached to a top drive and transfer torque from the top drive to a gripper; and a gripper for the casing running tool wherein the gripper comprises:

an inner mandrel comprising a profile suitable for torque load transfer at the top and the bottom of the inner mandrel;

wherein the inner mandrel comprises a recessed portion located between the top profile and bottom profile;

wherein the recessed portion comprises a plurality of shoulders; and a split sleeve having a diameter wherein the split sleeve is configured to be installed in the recessed portion of the inner mandrel;

wherein the split sleeve comprises an inner profile configured to mate with (1) the top profile and bottom profile of the inner mandrel and (2) the plurality of shoulders of the recessed portion of the inner mandrel;

wherein the split sleeve is split longitudinally into at least two pieces wherein the at least two pieces of the split sleeve are configured to be longitudinally fastened together; and wherein the inner mandrel and split sleeve are in rotational communication when the at least two pieces of the split sleeve are longitudinally fastened together and the split sleeve is installed in the recessed portion of the inner mandrel; and (2) selecting the diameter of the split sleeve diameter such that the diameter is sufficient for the making up of the tubulars to be connected.

21. A gripper for a casing running tool comprising:

an inner mandrel comprising a profile suitable for torque load transfer at the top and the bottom of the inner mandrel;

wherein the inner mandrel comprises a recessed portion located between the top profile and bottom profile;

wherein the recessed portion comprises a plurality of shoulders; and a sleeve configured to be installed in the recessed portion of the inner mandrel;

wherein the sleeve comprises an inner profile configured to mate with (1) the top profile and bottom profile of the inner mandrel and (2) the plurality of shoulders of the recessed portion of the inner mandrel; and wherein the inner mandrel and sleeve are in rotational communication when the sleeve is installed in the recessed portion of the inner mandrel.

22. The gripper of embodiment 21 wherein the profile suitable for torque load transfer at the top and the bottom of the inner mandrel are the same.

23. The gripper of embodiment 21 wherein the profile suitable for torque load transfer comprises (1) a polygonal profile selected from a polygon comprising from about 4 to about 12 sides or (2) a splined profile.

24. The gripper of embodiment 21 wherein the sleeve is a unitary sleeve.

25. The gripper of embodiment 21 wherein the inner mandrel comprises a key and wherein the sleeve comprises a key slot to match the key of the inner mandrel.

In the preceding specification, various embodiments have been described with references to the accompanying drawings. It will, however, be evident that various modifications and changes may be made thereto, and additional embodiments may be implemented, without departing from the broader scope of the invention as set forth in the claims that follow. The specification and drawings are accordingly to be regarded as an illustrative rather than restrictive sense.

I claim:

1. A gripper for a casing running tool, comprising:

an inner mandrel comprising opposing first and second end portions, the first end portion comprising a first profile suitable for torque load transfer at the first end portion of the inner mandrel and the second end portion comprising a second profile suitable for torque load transfer at the second end portion of the inner mandrel;

wherein the inner mandrel comprises a recessed portion located between the first profile and the second profile;

wherein the recessed portion comprises a plurality of shoulders; and a split sleeve configured to be installed in the recessed portion of the inner mandrel;

wherein the split sleeve comprises an inner profile configured to mate with (1) the first profile and the second profile of the inner mandrel and (2) the plurality of shoulders of the recessed portion of the inner mandrel;

wherein the split sleeve is split longitudinally into at least two pieces wherein the at least two pieces of the split sleeve are configured to be longitudinally fastened together;

wherein the inner mandrel and split sleeve are in rotational communication when the at least two pieces of the split sleeve are longitudinally fastened together and the split sleeve is installed in the recessed portion of the inner mandrel; and wherein the split sleeve comprises an outer profile comprising a plurality of ramps, wherein each ramp comprises one or more rollers thereon, and wherein the outer profile is configured such that the one or more rollers exhibit a radial force when the split sleeve is subjected to a downward force.

2. The gripper of claim 1, wherein the first profile suitable for torque load transfer at the first end portion or the second profile suitable for torque load transfer at the second end portion comprises (1) a polygonal profile selected from a polygon comprising 4 to 12 sides or (2) a splined profile.

3. The gripper of claim 1, wherein the first and second profiles suitable for torque load transfer at the first and second end portions of the inner mandrel, respectively, are the same.

4. The gripper of claim 1, wherein the first and second profiles suitable for torque load transfer at the first and second end portions of the inner mandrel, respectively, comprise octagonal profiles.

5. The gripper of claim 1, wherein the plurality of shoulders comprises 3 to 40 shoulders.

6. The gripper of claim 5, wherein the plurality of shoulders comprises 20 to 30 shoulders.

7. The gripper of claim 1, wherein the split sleeve is substantially cylindrical.

8. The gripper of claim 7, wherein the at least two pieces of the split sleeve comprise two semicircular pieces, and wherein the two semicircular pieces comprise substantially the same outer perimeter.

9. The gripper of claim 8, wherein the two semicircular pieces are configured to be longitudinally fastened together with a screw adjacent the first profile of the inner mandrel and a second screw adjacent the second profile of the inner mandrel.

10. The gripper of claim 1, wherein the at least two pieces of the split sleeve are configured to be longitudinally fastened together with a screw adjacent the first profile of the inner mandrel and a second screw adjacent the second profile of the inner mandrel.

11. The gripper of claim 1, wherein the plurality of shoulders are configured to transfer a tensile load of a tubular.

12. A gripper for a casing running tool, comprising:

an inner mandrel comprising opposing first and second end portions, the first end portion comprising a first profile suitable for torque load transfer at the first end portion of the inner mandrel and the second end portion comprising a second profile suitable for torque load transfer at the second end portion of the inner mandrel;

wherein each of the first and second profiles comprises an octagonal profile;

wherein the inner mandrel comprises a recessed portion located between the first profile and second profile; and wherein the recessed portion comprises 20 to 30 shoulders; and a split sleeve configured to be installed in the recessed portion of the inner mandrel;

wherein the split sleeve comprises an inner profile configured to mate with (1) the first profile and the second profile of the inner mandrel and (2) the 20 to 30 shoulders of the recessed portion of the inner mandrel;

wherein the split sleeve is split longitudinally into two semicircular pieces having substantially the same outer perimeter and configured to be longitudinally fastened together with a first screw near the first profile and a second screw near the second profile;

wherein the split sleeve comprises an outer profile comprising a plurality of ramps, wherein each ramp comprises one or more rollers thereon, and wherein the outer profile is configured such that the one or more rollers exhibit a radial force when the split sleeve is subjected to a downward force; and wherein the inner mandrel and split sleeve are in rotational communication when the two semicircular pieces of the split sleeve are longitudinally fastened together and the split sleeve is installed in the recessed portion of the inner mandrel.

13. A casing running tool, comprising:

an actuator configured to be attached to a top drive and transfer torque from the top drive to a gripper; and a gripper for the casing running tool wherein the gripper comprises:

an inner mandrel comprising opposing first and second end portions, the first end portion comprising a first profile suitable for torque load transfer at the first end portion of the inner mandrel and the second end portion comprising a second profile suitable for torque load transfer at the second end portion of the inner mandrel;

wherein the inner mandrel comprises a recessed portion located between the first profile and second profile;

wherein the recessed portion comprises a plurality of shoulders; and a split sleeve configured to be installed in the recessed portion of the inner mandrel;

wherein the split sleeve comprises an inner profile configured to mate with (1) the first profile and the second profile of the inner mandrel and (2) the plurality of shoulders of the recessed portion of the inner mandrel;

wherein the split sleeve is split longitudinally into at least two pieces configured to be longitudinally fastened together;

wherein the inner mandrel and split sleeve are in rotational communication when the at least two pieces of the split sleeve are longitudinally fastened together and the split sleeve is installed in the recessed portion of the inner mandrel; and wherein the split sleeve comprises an outer profile comprising a plurality of ramps, wherein each ramp comprises one or more rollers thereon, and wherein the outer profile is configured such that the one or more rollers exhibit a radial force when the split sleeve is subjected to a downward force.

14. The casing running tool of claim 13, wherein the first and second profiles suitable for torque load transfer at the first and second end portions of the inner mandrel, respectively, comprise an octagonal profile.

15. The casing running tool of claim 13, wherein the plurality of shoulders comprises 20 to 30 shoulders.

16. The casing running tool of claim 13, wherein the at least two pieces of the split sleeve are configured to be longitudinally fastened together with a first screw adjacent the first profile of the inner mandrel and a second screw adjacent the second profile of the inner mandrel, wherein the at least two pieces of the split sleeve comprise two semicircular pieces, and wherein the two semicircular pieces comprise substantially the same outer perimeter.

17. The casing running tool of claim 13, wherein the plurality of shoulders are configured to transfer a tensile load of a tubular.

18. A process of using a casing running tool, comprising:

providing a casing running tool for making up tubular connections, wherein the casing running tool comprises:

an actuator configured to be attached to a top drive and transfer torque from the top drive to a gripper; and a gripper for the casing running tool wherein the gripper comprises:

an inner mandrel comprising opposing first and second end portions, the first end portion comprising a first profile suitable for torque load transfer at the first end portion of the inner mandrel and the second end portion comprising a second profile suitable for torque load transfer at the second end portion of the inner mandrel;

wherein the inner mandrel comprises a recessed portion located between the first profile and second profile;

wherein the recessed portion comprises a plurality of shoulders; and a split sleeve having a diameter wherein the split sleeve is configured to be installed in the recessed portion of the inner mandrel;

wherein the split sleeve comprises an inner profile configured to mate with (1) the first profile and the second profile of the inner mandrel and (2) the plurality of shoulders of the recessed portion of the inner mandrel;

wherein the split sleeve is split longitudinally into at least two pieces configured to be longitudinally fastened together;

wherein the inner mandrel and split sleeve are in rotational communication when the at least two pieces of the split sleeve are longitudinally fastened together and the split sleeve is installed in the recessed portion of the inner mandrel; and wherein the split sleeve comprises an outer profile comprising a plurality of ramps, wherein each ramp comprises one or more rollers thereon, and wherein the outer profile is configured such that the one or more rollers exhibit a radial force when the split sleeve is subjected to a downward force;

selecting the diameter of the split sleeve such that the diameter facilitates the making up of the tubulars connections; and making up tubular connections using the casing running tool.

19. A gripper for a casing running tool, comprising:

an inner mandrel comprising opposing first and second end portions, the first end portion comprising a first profile suitable for torque load transfer at the first end portion of the inner mandrel and the second end portion comprising a second profile suitable for torque load transfer at the second end portion of the inner mandrel;

wherein the inner mandrel comprises a recessed portion located between the first profile and the second profile;

wherein the recessed portion comprises a plurality of shoulders; and a split sleeve configured to be installed in the recessed portion of the inner mandrel;

wherein the split sleeve comprises an inner profile configured to mate with (1) the first profile and the second profile of the inner mandrel and (2) the plurality of shoulders of the recessed portion of the inner mandrel;

wherein the inner mandrel and sleeve are in rotational communication when the sleeve is installed in the recessed portion of the inner mandrel; and wherein the split sleeve comprises an outer profile comprising a plurality of ramps, wherein each ramp comprises one or more rollers thereon, and wherein the outer profile is configured such that the one or more rollers exhibit a radial force when the split sleeve is subjected to a downward force.

20. The gripper of claim 19, wherein the first and second profiles suitable for torque load transfer at the first and second end portions of the inner mandrel, respectively, are the same.

21. The gripper of claim 19, wherein the first or second profile suitable for torque load transfer comprise (1) a polygonal profile selected from a polygon comprising 4 to 12 sides or (2) a splined profile.

22. The gripper of claim 19, wherein the inner mandrel comprises a key, and wherein the sleeve comprises a key slot to match the key of the inner mandrel.

* * * * *